US008012598B2

(12) United States Patent
Naumann et al.

(10) Patent No.: US 8,012,598 B2
(45) Date of Patent: Sep. 6, 2011

(54) METAL FOAM BODY HAVING AN OPEN-POROUS STRUCTURE AS WELL AS A METHOD FOR THE PRODUCTION THEREOF

(75) Inventors: Dirk Naumann, Mississauga (CA); Gunnar Walther, Dresden (DE); Alexander Böhm, Hähnichen (DE)

(73) Assignees: Alantum Corporation, Sangdaewon-dong, Joongwon-gu, Seongnam, Gyonggi-do (KR); Fraunhofer Gesellschaft zur Forderung der angewandten Forschung E.V., Hansastrasse (DE)

( * ) Notice: Subject to any disclaimer, the term of this patent is extended or adjusted under 35 U.S.C. 154(b) by 1379 days.

(21) Appl. No.: 10/592,181

(22) PCT Filed: Mar. 8, 2005

(86) PCT No.: PCT/EP2005/002435

§ 371 (c)(1),
(2), (4) Date: Sep. 8, 2006

(87) PCT Pub. No.: WO2005/095029

PCT Pub. Date: Oct. 13, 2005

(65) Prior Publication Data

US 2008/0171218 A1 Jul. 17, 2008

(30) Foreign Application Priority Data

Mar. 19, 2004 (DE) ..... 10 2004 014 076

(51) Int. Cl.
*B32F 3/11* (2006.01)

(52) U.S. Cl. ..... 428/613

(58) Field of Classification Search ..... None
See application file for complete search history.

(56) References Cited

U.S. PATENT DOCUMENTS

| | | | | | |
|---|---|---|---|---|---|
| 2,096,252 | A | * | 10/1937 | Koehring | 419/27 |
| 2,190,237 | A | * | 2/1940 | Koehring | 419/3 |
| 2,671,955 | A | * | 3/1954 | Grubel et al. | 428/545 |
| 3,328,139 | A | * | 6/1967 | Hodge et al. | 428/566 |
| 3,694,325 | A | * | 9/1972 | Katz et al. | 205/75 |
| 3,703,786 | A | * | 11/1972 | Swan | 47/56 |
| 3,807,146 | A | * | 4/1974 | Witkowski | 55/357 |
| 3,969,084 | A | * | 7/1976 | Watanabe et al. | 428/567 |
| 4,000,525 | A | * | 1/1977 | Klawitter et al. | 623/20.32 |
| 4,136,427 | A | * | 1/1979 | Shum | 29/890.045 |
| 4,155,755 | A | * | 5/1979 | Sara | 148/514 |
| 4,882,232 | A | * | 11/1989 | Bugnet et al. | 428/613 |
| 5,284,286 | A | * | 2/1994 | Brofman et al. | 228/19 |
| 5,588,477 | A | * | 12/1996 | Sokol et al. | 164/34 |
| 5,640,669 | A | * | 6/1997 | Harada et al. | 428/552 |
| 5,842,531 | A | * | 12/1998 | McDowell | 175/372 |
| 5,851,599 | A | * | 12/1998 | Harada et al. | 427/531 |

FOREIGN PATENT DOCUMENTS

| | | |
|---|---|---|
| EP | 0 721 994 | 7/1996 |
| EP | 1 065 020 | 1/2001 |
| EP | 0 921 210 | 10/2002 |
| JP | 1979-054916 | 5/1979 |
| JP | 1981-096087 | 8/1981 |
| JP | 08-225866 | 9/1996 |

OTHER PUBLICATIONS

Davies G.J. et al., Review Metallic foams: their production, properties and applications, Journal of Materials Science, 1983 (18), pp. 1899-1911.*

John Banhart, "Manufacture, characterization and application of cellular metals and metal foams", Progress in Materials Science 46 (2001) 559-632.

* cited by examiner

*Primary Examiner* — Timothy Speer
*Assistant Examiner* — Adam Krupicka
(74) *Attorney, Agent, or Firm* — Lexyoume IP Group, PLLC.

(57) ABSTRACT

The invention relates to metal foam bodies having an open-porous structure as well as a method for producing thereof wherein according to the set task such metal foam bodies are to be provided which achieve an increased oxidation resistance and/or an increased corrosion resistance. With the metal foam bodies having an open-porous structure according to the invention, for such metal foam bodies within the webs of the open-porous structure there are channel shaped cavities formed as being determined by the production. At the same time, the webs and cavities will be provided with a metallic protective layer made of a material differing from the metallic starting material of the foam body or the channel shaped cavities will be filled with this material. For this, an adequate metal powder or an alloy component being included in the powder will be used which becomes liquid and forms a liquid phase respectively during thermal treatment below a temperature at which the metal of the base foam body is melting. Due to the capillary action wetting the surfaces of channel shaped cavities within the webs can be achieved such that after cooling down a metallic protective layer is forming or the channel shaped cavities are filled.

3 Claims, No Drawings

METAL FOAM BODY HAVING AN OPEN-POROUS STRUCTURE AS WELL AS A METHOD FOR THE PRODUCTION THEREOF

The invention relates to metal foam bodies having an open-porous structure as well as to respective manufacturing processes.

Metal foam bodies having an open-porous structure can be produced in a different manner wherein a profitable procedure is based on two different ways in principle.

In both cases, a porous structure element made of an organic material is used, and the particular surfaces of which are provided with a plating, wherein subsequently during a thermal treatment the organic components of the structure element are thermally expelled.

Thus a galvanic metallization can be implemented in one way on the surfaces of such an open-porous organic structure element, for example. Alternatively, a homogeneous chemical vapour deposition of metals can be carried out on the surface (Ni, e.g.).

Alternatively for this, such a metal layer can be similarly produced according to the so called "Schwarzwalder method". As a result a suspension/dispersion agent including metal powder is deposited on the surfaces of the organic structure elements, and subsequently a coated structure element prepared in this manner is subjected to a thermal treatment wherein as already touched on the organic components are expelled, and sintering is carried out.

As being determined by the production, however, channel shaped cavities remain within webs which form the supporting framework of metallic foam bodies because in this place the respective organic component has been filling the corresponding space before the thermal treatment.

However, the webs as being a supporting structure of a particular metal foam body comprise open entrances toward the surrounding atmosphere, and the channel shaped cavities formed within the webs are not sealed a hundred percent in a fluid-tight manner to the surrounding media (atmosphere).

However, depending on the appropriate manufacturing processes, not all metals and metal alloys respectively are allowed to be used for the production of such open-porous metal foam bodies, and a great number of the appropriate metals and metal alloys have a tendency to oxidize or they lack of sufficiently high corrosion resistance under respective circumstances. In many cases of application of metallic open-porous foam bodies thus correspondingly oxidized or corroded surfaces as well are unsuitable without any additional protection, and they achieve either worse properties or interferences leading up to the destruction are allowed to occur.

Therefore it is an object of the invention to provide metal foam bodies having an open-porous structure which achieve an increased oxidation resistance and/or corrosion resistance.

According to the invention, this object is solved with metal foam bodies which have the features of patent claim 1. Advantageous embodiments and improvements of the invention can be achieved with the features indicated in the subordinate claims.

With the metal foam bodies having an open-porous structure according to the invention, the channel shaped cavities formed in advance as being determined by the production are provided within the webs of the respective open-porous structure with a protective layer on their inner surfaces, or the channel shaped cavities are allowed to be completely or at least partially filled, however. The protective layer and filling respectively on/into channel shaped cavities are then formed from a material differing from the metallic starting material of the foam body.

As a result, not only the disadvantages, as mentioned in the introductory part of the description, of metal foams having an open-porous structure can be eliminated in which channel shaped cavities have remained in the webs, however, they can also be produced accordingly in a simple and relatively reasonable manner.

Thus, during the production of metal foam bodies according to the invention, it will be acted such that a coating of a metallic base foam body is performed with a binder and a metal powder. As a result, coating is to be carried out such that not only outer surfaces of a respective base foam body are coated but coating is also carried out into the individual pores, and the plurality of the webs is covered with the coating material.

The metal powder used is then selected such that it melts below the melting temperature of the material of the base foam body which accordingly the webs are formed from as well, or such that at least one alloy component being included in the respective metal powder forms a liquid phase.

Then, the melt and liquid phase respectively due to the capillary action pass through apertures/pores of the web walls into the channel shaped cavities wetting at the same time the inner surface thereof. This will be covered with the melt and liquid phase respectively, and therefrom a protective layer is formed on the inner surface of channel shaped cavities in webs, or the channel shaped cavities will be filled with it.

After cooling down and solidifying of the protective layer and filling respectively, there is a metallic foam body according to the invention which still has an open-porous structure with improved properties in particular as for its oxidation resistance and corrosion resistance.

With a suitable selection of the composition of metal powder and a corresponding combination to the respective metal of the base foam body, however, intermetallic phases or liquid solutions or such a metal foam body as a whole can be formed within the channel shaped cavities at least at the interfaces toward the web material.

The invention can be applied with different base foam bodies. Thus, with the manufacturing process according to the invention metal foam bodies made of nickel and having an open-porous structure can be used in combination with metal powders of a nickel base alloy, an aluminium base alloy or an aluminium powder, for example, which then the protective layers and fillings respectively can be formed from within the channel shaped cavities.

With the base foam bodies made of iron metal powder of nickel base alloys, aluminium base alloys as well as pure aluminium powder can be used.

However, copper and copper alloys respectively can be used for the protective layers and filling respectively.

In the nickel and aluminium base alloys the proportion of nickel and aluminium each should amount to at least 40 percent by weight. As further alloy elements can be included iron, cobalt, carbon, niobium, silicon, nickel, copper, titanium, chromium, magnesium, vanadium and/or tin.

Examples for nickel base alloys are known under trade name "Nicrobraz" from Wall Colomonoy Corp. in two different qualities and compositions. A first is LM-BNi-2: Cr 7; Si 4.5; B 3.1; Fe 3; C 0.03 (Ni Balance) melting and brazing temperature in the range 970-1170° C. and a second is 30-BNi-5: Cr 19; Si 10.2; C 0.03 (Ni Balance) with melting and brazing temperature in the range 1080-1200° C.

With base foam bodies made of copper, metal powder of a tin base alloy is to be preferred in which the proportion of tin should amount to at least 50 percent by weight. In a tin base alloy, lead, nickel, titanium, iron and/or manganese can be included as additional alloy elements.

For the production of metal foam bodies according to the invention, a metallic base foam body should be used wherein the free cross sections of the channel shaped cavities within webs should be less than 30 percent of the average pore size of the respective base foam body, however, should have an inner diameter with a maximum of 1000 μm. With such a dimensional design of the free cross sections of channel shaped cavities, sufficiently large capillary actions can be ensured for placing the melt and liquid phase respectively with wetting into the channel shaped cavities.

During the production of metallic foam bodies according to the invention the coating should be deposited in the open-porous base foam body with at least one binder and with the respective selected metal powder wherein this can be supported by pressing and/or set the base foam body vibrating (vibration).

Furthermore, the coating can be performed within a sealed container in which the internal pressure prevailing therein has been reduced.

In particular, with a base foam body made of nickel it is possible to carry out a deformation of the base foam body before performing the thermal treatment which is relatively easy to carry out with a nickel foam body. A coated nickel foam body provided into the respective shape is then allowed to be thermally treated accordingly in order to form the protective layers within the channel shaped cavities and to fill the channel shaped cavities respectively.

Previously performed modeling is particularly significant in terms that a distinctly increased mechanical strength can also be achieved by means of a nickel base alloy which is used according to the invention.

During the production in accordance with the invention of metal foam bodies having an open-porous structure it is possible to perform a removal of excessive melt still being liquid and of liquid phase respectively before completing the thermal treatment such that the initial porosity of the base foam body each used will only be reduced in a low extent if at all.

Subsequent to the formation of protective layers and filling channel shaped cavities respectively, repeated coating a metal foam body thus obtained can be carried out with a binder and a metal powder wherein a metal powder being different from that which has been used for the formation of protective layers or filling can particularly advantageously be used. The metal powder used for this can be another metal or is allowed to comprise a metal alloy composed in a different manner.

By means of such a procedure the surface being left, in particular the inner surfaces of the respective pores, can be additionally modified and coated respectively.

During the thermal treatment it can be operated in all cases with a protective atmosphere as well as a reducing atmosphere, however. An oxidizing atmosphere can be chosen for a calculated preliminary oxidation of the samples at the end of the process.

In the following, the invention shall be explained in more detail by way of example.

Embodiment 1

A base foam body made of nickel the porosity of which was in the range of between 92 and 96% has been immersed into a 1% aqueous solution of poly(vinyl pyrrolidone). After immersing compression against an absorbent pad has occurred such that excessive binder could be removed from pores and merely wetting the outer surfaces of the webs of the open-porous structure has been achieved. The nickel base foam body thus coated has been set vibrating and coated with a metal powder of a nickel base alloy having the following composition and an average particle size of 35 μm:

56.8 percent by weight of nickel
0.1 percent by weight of carbon,
22.4 percent by weight of chromium,
10.0 percent by weight of molybdenum,
4.8 percent by weight of iron,
0.3 percent by weight of cobalt,
3.8 percent by weight of niobium, and
1.8 percent by weight of silicon such that the particles of metal powder could adhere to the outer surfaces of the webs covering them in an almost all-over manner.

The nickel base foam body thus prepared has been subjected to a deformation such that a cylindrical shape could be obtained on the metal foam structure.

Subsequent to modeling wherein the particles of metal powder still remained adhering to the surfaces by means of the binder, a thermal treatment has been carried out in an oxygen atmosphere. Heating up was carried out with a warming-up rate of 5 K/min. In the range of 300 to 600° C., the binder was expelled wherein a detention time of appr. 30 min has been kept for this. Subsequent to this detention time the temperatures have been increased up to 1220 to 1380° C., and a detention time of 30 min has been kept within this temperature range.

As a result, a liquid phase could be formed from the metal powder used. The liquid phase could penetrate through pores or other apertures within the web walls into the channel shaped cavities arranged in such webs, and wetting of the respective inner walls of channel shaped cavities in the webs could be achieved by means of capillary action which after cooling down has resulted in the formation of a protective layer on the inner surfaces of channel shaped cavities within such webs.

The finished metal foam body subsequently still comprised a porosity of appr. 91% yet and has achieved a distinctly increased oxidation resistance in the air at temperatures of up to 1050° C. compared with the starting nickel base foam body. It also provided distinctly improved mechanical properties in comparison with a pure nickel foam body having an open-porous structure such as creep resistance, tenacity and strength for example, which in particular had a positive effect during dynamic loads acting thereon. The metal foam body thus produced could be deformed yet in certain limits wherein particular bending radii should be considered.

Embodiment 2

A base foam body made of nickel with a porosity in the range of between 92 and 96% has been machined mechanically on the outer surfaces thereof by grinding such that additional apertures on channel shaped cavities of webs have been created. A foam body thus prepared has been subsequently immersed into a 1% aqueous solution of poly(vinyl pyrrolidone) as a binder, and thereafter pressed against an absorbent pad to remove excessive binder out of the pores. At the same time wetting the web surfaces within the pores should remain ensured.

The nickel foam body thus prepared and coated with binder has been deposited with an aluminium powder mixture. The aluminium powder was made up of 1 percent by weight of aluminium powder having a flaky particle configuration (with an average particle size of less than 20 μm), and of 90 percent by weight of aluminium powder having a spherical particle configuration (with an average particle size of less than 100 μm) which have been drily mixed in advance over a time period of 10 min in an agitator.

Coating the surface wetted from binder with the aluminium powder mixture has taken place in a vibration apparatus such that the aluminium powder could be uniformly distributed within the open-porous structure, and at least the outer surfaces of webs have been covered with aluminium particles. The open-porous property of the structure has been substantially maintained.

The nickel base foam body thus prepared could be brought again before performing thermal treatment into an adequate shape which has then been substantially maintained as well after the thermal treatment.

The thermal treatment was carried out in a nitrogen atmosphere wherein a warming-up rate of 5 K/min was again maintained for setting free at temperatures in the range of between 300 and 600° C. at a detention time of 30 minutes, and then the final thermal treatment for the formation of nickel aluminide also in the channel shaped cavities of webs was carried out within a specific temperature range of between 900 and 1000° C. at a detention time of 30 minutes.

The metallic foam body thus produced in the end comprised a porosity of appr. 91% and was at least almost completely made up of nickel aluminide, and the channel shaped cavities within the webs were completely filled.

The metal foam body produced in this manner achieves an oxidation resistance in the air at temperatures up to 1050° C.

Embodiment 3

A base foam body made of iron and having a porosity in the range of between 92 and 96% was prepared with the binder and aluminium powder according to the embodiment 2 and was subsequently subjected to a thermal treatment in a hydrogen atmosphere wherein a warming-up rate of 5 K/min has been maintained again at the same conditions for expelling the organic components and for the final thermal treatment at higher temperatures within a temperature range of between 900 and 1150° C. at a detention time of 30 min.

After cooling down, the metal foam body thus produced has achieved a porosity of 91% and was almost completely made up of iron aluminide wherein the channel shaped cavities provided in advance within the base foam body as determined by the production were completely filled. The metal foam body produced in this manner was oxidation-resistant in the air at temperatures of up to 900° C.

Embodiment 4

A base foam body made of copper and having a porosity in the range of between 92 and 96% has been immersed into a 1% aqueous solution of poly(vinyl pyrrolidone) after mechanical preparatory treatment as with the embodiment 3, and subsequently the excessive binder has been removed by pressing against an absorbent pad.

The copper foam body wetted with binder at least on the surfaces of webs has been placed into a vibration apparatus and sprinkled on both sides with a tin powder (having an average particle size of 50 μm and a spherical particle configuration) in order to obtain a uniform distribution of the tin powder within the open-porous structure, and to achieve an almost complete covering of the outer surfaces of webs, in particular.

Subsequent to this, thermal treatment has taken place again wherein setting free with the same warming-up rate and detention time as with the embodiments 1 to 3 and following a temperature increase toward the range of 600 to 1000° C. at a detention time of 1 hour are carried out.

Subsequent to the thermal treatment a metal foam body made up almost completely of tin bronze could be obtained wherein the channel shaped cavities were almost completely filled. Compared with the initial foam body made of copper a significant increase of the mechanical strength could be achieved. The finished metal foam body has achieved a porosity of appr. 91% yet and still was mechanically deformable yet within limits keeping the particular bending radii.

The invention claimed is:

1. A metal foam body having an open-porous structure, said open-porous structure comprising webs forming a supporting framework of said metal foam body, wherein channel shaped cavities are formed within the webs of said open-porous structure as being determined by a production of a base foam body, wherein said channel shaped cavities are provided with a metallic protective layer on an inner surface of the channel shaped cavities, and the inner metallic protective layer being made of a second material being different from a metallic starting material of said base foam body, wherein the webs of the open-porous structure have an outer metallic protective layer formed thereon, the outer metallic protective layer also being made of the second material, wherein before the formation of said inner protective layer, the free cross sections of said channel shaped cavities within the webs are smaller than 30 percent of the average pore size of said base foam body, wherein said base foam body is produced from nickel, iron or copper, and wherein said inner and outer protective layers are comprised of aluminum, an aluminum base alloy, an aluminide, a tin base alloy or a copper base alloy.

2. The metal foam body of claim 1, wherein the inner metallic protective layer only partially fills the channel shaped cavities, such that the inner metallic protective layer surrounds a hollow region within the channel shaped cavities.

3. The metal foam body of claim 1, wherein the channel shaped cavities are further provided with a metallic coating layer on the inner metallic protective layer, the metallic coating layer being made of a third material that is different from the second material.

* * * * *